US007360650B2

(12) United States Patent
Hoffecker

(10) Patent No.: US 7,360,650 B2
(45) Date of Patent: Apr. 22, 2008

(54) MULTI-CHAMBERED COVER FOR A TOOTHBRUSH HEAD AND AN ORAL HYGIENE PRODUCT

(76) Inventor: Donald T. Hoffecker, 3515 Maxwell Ct., Bloomfield Hills, MI (US) 48301

( * ) Notice: Subject to any disclaimer, the term of this patent is extended or adjusted under 35 U.S.C. 154(b) by 175 days.

(21) Appl. No.: 11/131,057

(22) Filed: May 17, 2005

(65) Prior Publication Data

US 2005/0268935 A1 Dec. 8, 2005

Related U.S. Application Data

(60) Provisional application No. 60/571,730, filed on May 17, 2004.

(51) Int. Cl.
*B65D 85/00* (2006.01)
*A46B 7/00* (2006.01)
*A45D 44/18* (2006.01)

(52) U.S. Cl. ..... 206/362.3; 15/184; 132/309; 206/209.1

(58) Field of Classification Search ..... 206/361, 206/362.2, 362.3; 15/184; 132/308–309; 215/374–375; 220/608
See application file for complete search history.

(56) References Cited

U.S. PATENT DOCUMENTS 1,849,769 A 3/1932 Priest
1,962,337 A * 6/1934 Youngstrom ..... 132/308
2,061,430 A * 11/1936 Ley ..... 132/308
2,228,679 A * 1/1941 Tedesco ..... 132/308
2,673,641 A * 3/1954 Estrada Carrillo ..... 206/362.2
2,936,920 A * 5/1960 Wallace ..... 215/375
3,746,162 A * 7/1973 Bridges ..... 206/361
3,890,986 A 6/1975 Gerlich
4,835,813 A * 6/1989 Lorenzana et al. ..... 15/184
5,415,187 A 5/1995 Heneveld
5,701,921 A * 12/1997 Father et al. ..... 132/309
5,779,046 A 7/1998 Plakos
5,960,801 A * 10/1999 Vermooten et al. ..... 132/308
6,129,090 A 10/2000 Pillar et al.
6,390,103 B1 * 5/2002 Manso ..... 132/309
6,457,583 B1 * 10/2002 Tee et al. ..... 206/362.1
6,484,732 B1 * 11/2002 Simister ..... 132/309

FOREIGN PATENT DOCUMENTS

GB 462879 3/1937

OTHER PUBLICATIONS

International Search Report for Application No. PCT/05/017362 dated Feb. 14, 2006.

* cited by examiner

*Primary Examiner*—Bryon P Gehman
(74) *Attorney, Agent, or Firm*—Marshall, Gerstein & Borun LLP

(57) ABSTRACT

A cover for a toothbrush includes a first portion defining a first chamber and a second portion defining a second chamber, the first and second portions are joined so that the first and second portions may be moved relative to one another to expose the second chamber. A toothbrush may be partially or wholly disposed within the second chamber and a roll of dental floss may be disposed within the first chamber. The first and/or second portions may include one or more ventilation holes.

1 Claim, 4 Drawing Sheets

MULTI-CHAMBERED COVER FOR A TOOTHBRUSH HEAD AND AN ORAL HYGIENE PRODUCT

This patent is related to and claims priority benefit of provisional application Ser. No. 60/571,730, filed on May 17, 2004. This patent incorporates by reference all of the subject matter disclosed in the prior provisional application.

FIELD OF THE DISCLOSURE

The disclosure generally relates to protective covers for oral hygiene equipment and specifically relates to protective covers for toothbrushes.

BACKGROUND

Having the head of a toothbrush exposed is considered undesirable as it can be unhygienic. This is particularly a problem during travel when the brush is stored in a bag, shaving kit, suitcase or the like and can easily come into direct contact with nearby materials and/or objects. Lotions, perfumes and the like are particularly undesirable to have embedded in the bristles of the toothbrush. Further, any water remaining on the toothbrush bristles after use can cause the bag and its contents to get wet. Many people also use dental floss for hygiene and so there can be several items (e.g. toothbrush, toothpaste, floss, lotion, perfume or cologne, etc.) which need to be taken when travelling and that there is a corresponding risk of forgetting one or more of these items.

SUMMARY

A cover for a toothbrush includes a first portion and a second portion, connected to one another forming first and second chambers for substantially covering at least a portion of the toothbrush and for substantially containing an oral hygiene product. An opening is formed in the second portion for accessing the oral hygiene product. An aperture is formed in the first chamber for substantially surrounding the neck of a toothbrush. A plurality of ventilation holes are formed in one or both of the first and second portions to allow bristles on the head of the toothbrush to dry.

A door may be included on the second portion which substantially covers the opening and a cutter when the door is closed. A recessed area of the second portion facilitates opening the door. The first portion may include a longitudinally convex foot for stabilizing the cover when placed on a support surface.

While the invention has been described above, it extends to any inventive combination of the features set out above or in the following description.

BRIEF DESCRIPTION OF THE DRAWINGS

The invention may be performed in various ways, and, by way of example only, will now be described with reference to the accompanying figures, in which.

DETAILED DESCRIPTION

Figure 1:
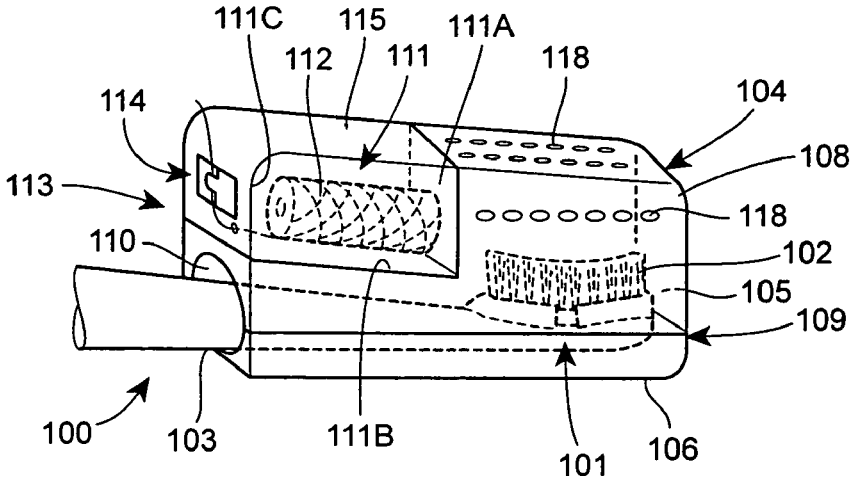
FIG. 1 is a perspective view of one example of a toothbrush cover constructed in accordance with the teachings of the disclosure.

FIG. 1 shows a portion of a conventional toothbrush 100 comprising a shaft/handle, one end of which forms a head 101 that includes a plurality of upstanding bristles 102. The toothbrush 100 may be electrically or manually powered.

A cover 104 is disposed over the head 101 of the toothbrush 100. The cover 104 is generally cuboid in shape and comprises a lower portion or tray 106 and an upper portion or lid 108 which are joined at a hinge 109. The terms upper and lower are being used in view of the orientation of the cover 104 as shown in the figures. The hinge 109 may be an integral hinge formed of one or more thin sections of material, or in other words, a "living hinge". The hinge 109 is located along an end wall 105 of the upper portion or lid 108. The mating edges of the upper portion or lid 108 and the lower portion or tray 106 are shaped for a snap-fit and releasably fasten the cover 104 in a closed condition over the head 101 of the brush 100. It will be appreciated that any other type of hinge and/or fastener may be used or that the two portions could be completely separate and fastened with a snap fit along the adjacent edges of the top portion or lid 108 and the bottom portion or tray 106.

The cover 104 may be formed of any suitable material, e.g. plastic, and may be at least partially transparent. It will be appreciated that the shape of the cover 104 can be varied so that it closely matches a particular design of toothbrush or, as shown in FIG. 1, it can be generally cuboid in shape so that it will fit over all or the majority of conventional toothbrush heads.

An aperture 110 is formed at a brush handle end 113 of the cover 104 allowing the cover 104 to fit around a neck 103 of the toothbrush 100. In the example of FIG. 1, the aperture 110 spans the brush handle end 113 of both portions 106, 108 and around the neck 103 of the toothbrush 100. However, the aperture 110 may alternatively be disposed in either the upper portion or lid 108 or the lower portion or tray 106.

A chamber 111 is formed within the upper portion or lid 108 of the cover 104 by two spaced apart and opposed chamber end walls 111A, 111C, a chamber base 111B and an upper surface 115 of the cover 104. The chamber end wall 111A is located approximately at a lengthwise midpoint of the cover 104. The chamber base 111B extends substantially perpendicularly from one chamber end wall 111C to the other chamber end wall 111A, thus forming the generally cuboid-shaped chamber 111. One chamber end wall 111A is sized to allow the chamber base 111B to lie proximate to the handle of the brush 100. In the example of FIG. 1, the chamber base 111B extends from one chamber end wall 111C at a point proximate to the aperture 110.

The chamber 111 may contain a reel of dental floss 112 mounted on a spindle (not shown) extending from one chamber end wall 111A. The free end of the dental floss 112 passes out of the upper portion or lid 108 adjacent a floss cutter 114 attached to the brush handle end 113 of the cover 104. The floss cutter 114 includes a "C" shaped metal tab that acts as a cutting edge and which can also be used to retain the free end of the floss in place after cutting. In some embodiments the upper portion or lid 108 of the cover 104 may be formed of more than one section such that the chamber 111 can be opened/removed to allow replacement of the floss 112.

The upper portion or lid 108 of the cover 104 may include a plurality of ventilation holes 118 which can be located on an upper surface and/or on side/end walls of the upper portion or lid 108. These ventilation holes 118 are normally located in the end of the cover which contains the bristles 102 of the toothbrush 100 and assist in drying the bristles 102, while preventing direct contact between the bristles 102 and other external materials and/or objects.

Figure 2:
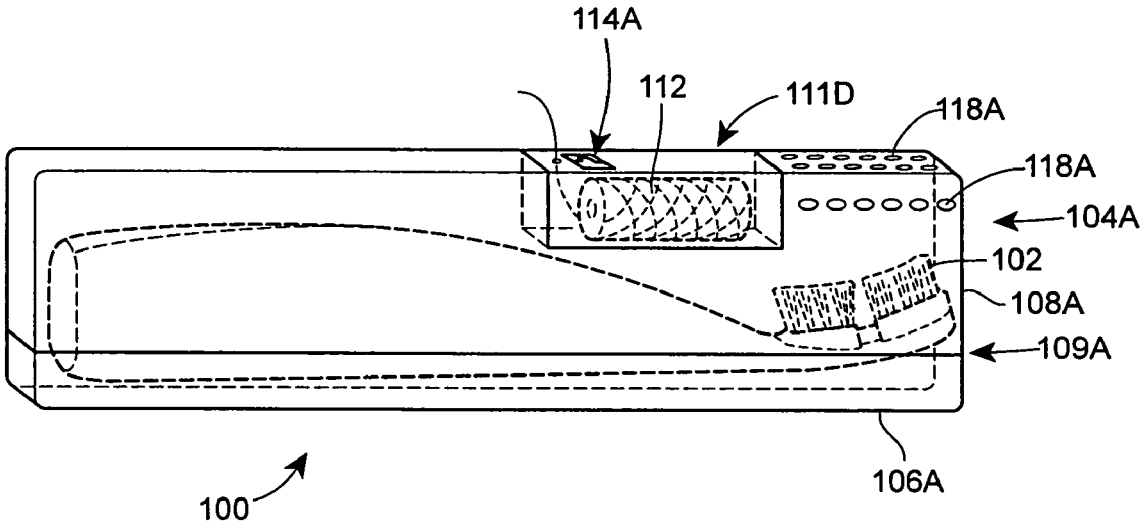
FIG. 2 is a perspective view of a second example of a toothbrush cover constructed in accordance with the teachings of the disclosure.

Referring now to FIG. 2, a second embodiment of a cover is shown where like parts are numbered accordingly. In this embodiment, the cover 104A is used to contain the whole of the toothbrush 100 and comprises a lower portion or tray 106A and an upper portion or lid 108A, connected by an integrally formed living hinge 109A running along one side of the cover 104A so that it may be opened exposing the toothbrush 100. In this embodiment, the cover 104A again includes a chamber 111D containing a spool of dental floss 112 which may be dispensed and cut via a floss cutter 114A. As will be appreciated, the cover 104A essentially acts as a carrying case for the toothbrush 100 and dental floss 112 which, by virtue of ventilation holes 118A allows the bristles 102 to dry after use. This particular embodiment may also be usefully modified to include a storage facility for e.g. toothpaste or other accoutrements, such as toothpicks. For toothpaste, the storage facility may also include means to progressively squeeze toothpaste from a tube thereof, such as by a ratchet arrangement providing e.g. sliding movement over the tube in one direction only.

Figure 3:
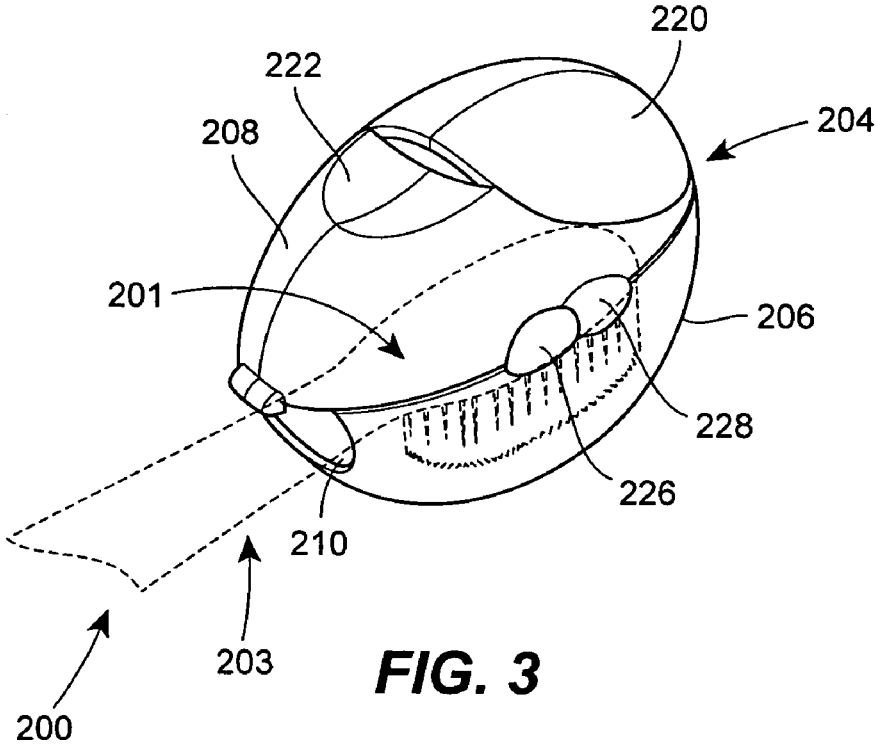
FIG. 3 is a perspective view of a third example of a toothbrush cover constructed in accordance with the teachings of the disclosure.

FIG. 3 illustrates a third embodiment of a cover 204. In this embodiment, the cover 204 substantially surrounds the head 201 of the toothbrush 200, similar to the embodiment of FIG. 1. The cover 204, however, instead of having a cuboid shape is substantially ovoid or egg shaped. The cover 204 includes a door 220 on the rear side thereof for accessing the free end of the dental floss 212. The rear side of the cover 204 also includes a recessed area 222 which facilitates opening of the door 220. The door 220 may be attached to the upper portion or lid 208 via a hinge 252 (shown in FIG. 5.). The tray 206 includes an aperture 210 which substantially surrounds the neck 203 of the toothbrush 200.

A laterally projecting ridge 226 protrudes outward from the lid 208 along a side surface thereof. A second laterally projecting ridge 228 protrudes outward from the tray 206 proximate the first ridge 226 of the lid 208. The two ridges 226, 228 frictionally engage one another when the cover 204 is in a closed position, providing a catch for latching the cover 204 in the closed position. A user may overcome this frictional lock by exerting a separating force between the first ridge 226 and the second ridge 228 substantial enough to overcome the frictional force between the ridges 226, 228. This may be accomplished easily by exerting a twisting motion on the ridges 226 and 228 using a thumb and forefinger.

Figure 4:
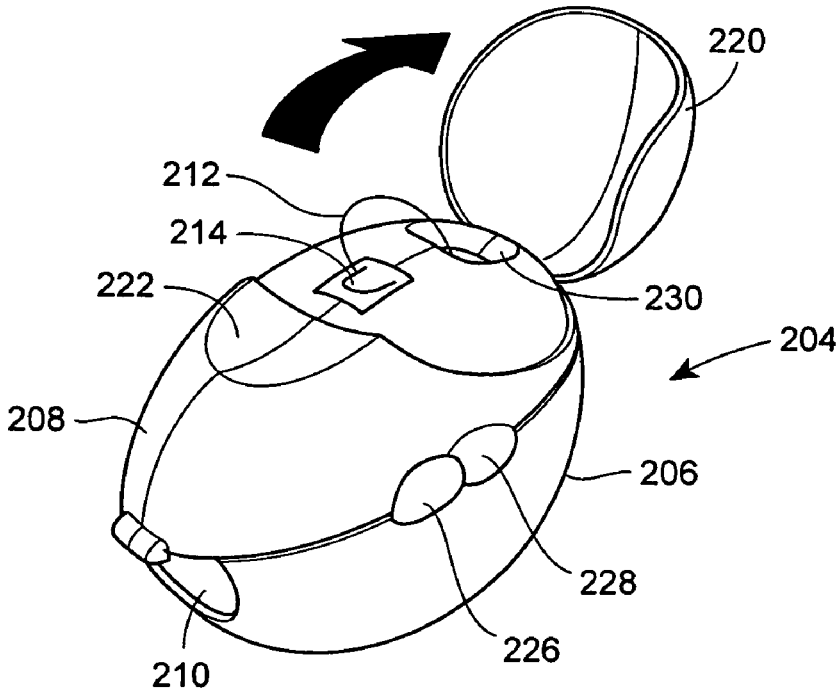
FIG. 4 is a second perspective view of the toothbrush cover of FIG. 3.

FIG. 4 illustrates the cover 204 of FIG. 3 with the door 220 in an open condition. The free end of the dental floss 212 exits the lid 208 through an opening 230 in a rear wall of thereof. A semi-circular floss cutter 214 is disposed on the outside of the rear wall of the lid 208. The floss cutter 214 may be attached to the rear wall via any acceptable method including, but not limited to, an adhesive, a weld, a magnet, a staple, a stitch, etc. The floss cutter 214 includes a sharp cutting surface along an arcuate portion that is sharp enough to cut the dental floss 212 at a location chosen by the user. Additionally, the arcuate portion of the cutter 214 meets at the base of the cutter 214 and forms a surface which engages the free end of the dental floss 212 after a user has cut a portion of the dental floss 212 thereby securing the free end of the dental floss 212 so that it will not return to the inside of the lid 208.

Figure 5:
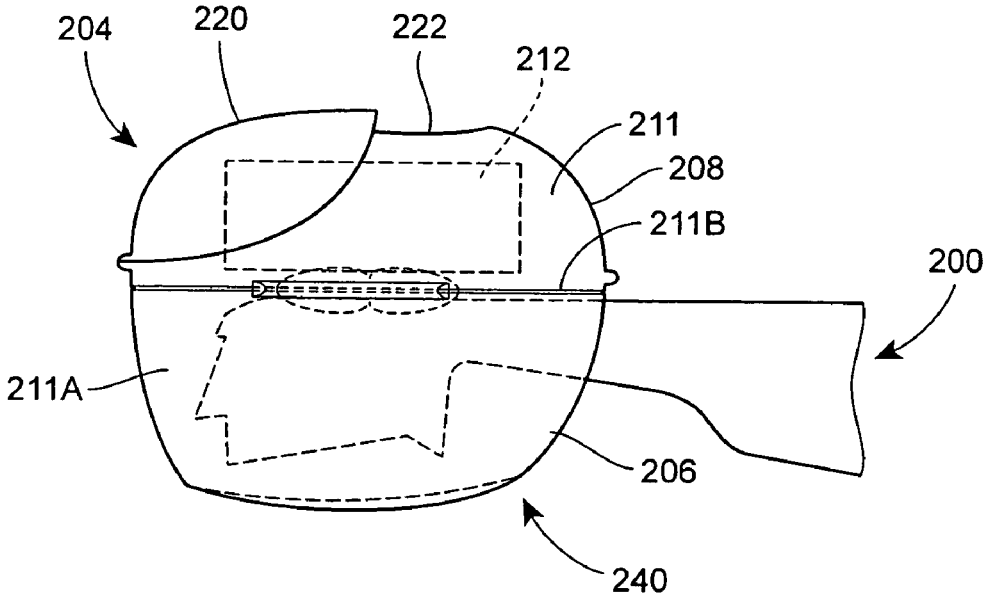
FIG. 5 is a side elevational view of the toothbrush cover of FIG. 3.
Figure 6:
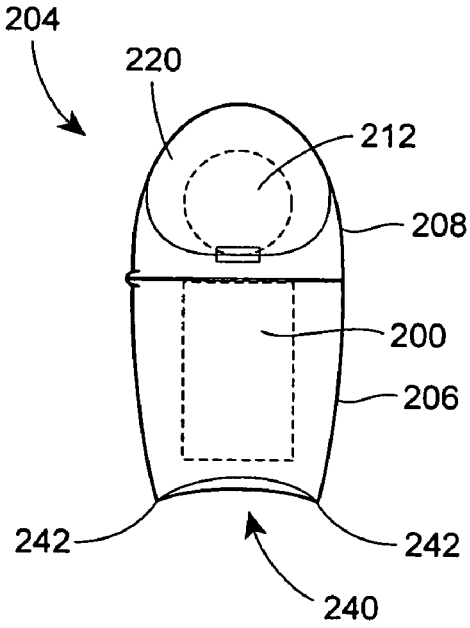
FIG. 6 is a top plan view of the toothbrush cover of FIG. 3.

FIG. 5 is a side view of the cover 204 of FIG. 3 showing the toothbrush 200 and the dental floss 212 in phantom. A first chamber 211 is formed between the lid 208 and a chamber base 211B and a second chamber 211A is formed between the tray 206 and the chamber base 211B. In some embodiments the lid 208 may be formed of more than one section such that the first chamber 211 can be opened/removed to allow replacement of the floss 212. The tray 206 includes a convexly shaped foot 240. The convex shape of the foot 240 provides a stabilizing structure when the holder is placed on a support surface, such as, for example, a countertop. The convex shape of the foot 240 also provides at least two contact points regardless of the shape of the toothbrush 200. Referring to FIG. 6, the foot 240, while convex longitudinally is concave laterally thereby forming two support edges 242, 244. The lateral concave shape of the foot 240 allows the center of gravity of the toothbrush 200 and cover 204 combination to reside between the stabilizing edges 242, 244, which in turn allows the toothbrush 200 and cover 204 combination to rest in a statically stable condition when placed on a support surface.

Figure 7:
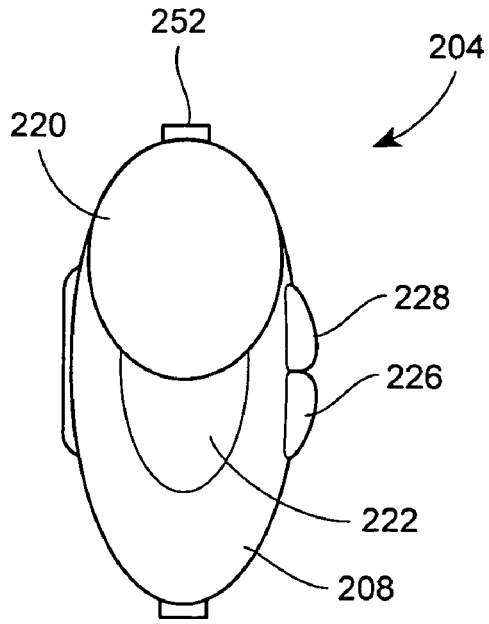
FIG. 7 is a rear elevational view of the toothbrush cover of FIG. 3.

FIG. 7 is a top plan view of the cover 204 of FIG. 3. The door 220 is generally ovoid in shape and coupled by a hinge 252 to the lid 208 at one end.

Figure 8:
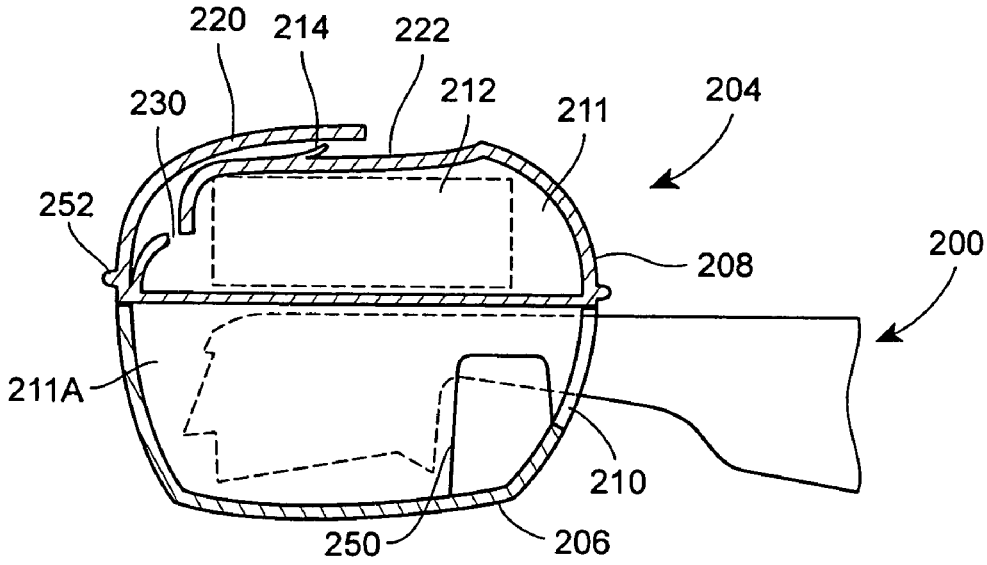
FIG. 8 is a side cutaway view of the toothbrush cover of FIG. 3.

FIG. 8 is a side cut-away view of the cover 204 of FIG. 3. The aperture 210 is disposed at one end of the tray 206. Additionally, two ribs 250 are attached to an inner surface of the tray 206. These ribs 250 are flexible and contact the neck of the toothbrush 200 when a toothbrush is disposed in the cover 204. The ribs 250 are sufficiently flexible to conform to a wide range of toothbrush 200 sizes and shapes. The ribs 250 help to secure the cover 204 on the toothbrush 200.

The two chamber construction is evident in FIG. 8. The second chamber 211A contains the head of the toothbrush 200 while the first chamber 211 contains the dental floss 212. The rear wall of the lid 208 includes the opening 230 through which the free end of the dental floss 212 passes. The floss cutter 214 both cuts the dental floss 212 to length and secures the free end of the dental floss 212. The door 220 covers the opening 230, the cutter 214 and the free end of the dental floss 212 when in a closed condition. Additionally, the recessed area 222 facilitates opening the door 220.

Although certain functions and features have been described herein in accordance with the teachings of the present disclosure, the scope of coverage of this patent is not limited thereto. On the contrary, this patent covers all embodiments of the teachings of the disclosure that fairly fall within the scope of permissible equivalents.

The invention claimed is:

1. A cover for a toothbrush comprising: a first portion defining a first chamber and a second portion defining a second chamber, the first and second portions being hingedly connected so that the first and second portions may be pivoted about a hinge to expose the second chamber; wherein the first portion includes a first ridge protruding outward from one side of the first portion, wherein the first portion includes a door that covers an opening in a wall of the first portion and a cutter disposed on the wall of the first portion, wherein the first portion includes a recessed area disposed proximate one end of the door, wherein the second portion has an aperture disposed at one end and a second ridge protruding outward from one side of the second portion proximate the first ridge, wherein the second portion includes a longitudinally convex and laterally concave foot, wherein the second portion includes a flexible rib disposed on an inner surface, proximate the aperture, and wherein a plurality of ventilation holes are disposed on one of the first and second portions.

* * * * *